United States Patent [19]

Yamakita

[11] Patent Number: 4,726,318

[45] Date of Patent: Feb. 23, 1988

[54] METHOD OF AND APPARATUS FOR DYEING PARTS MOLDED OF SYNTHETIC RESIN

[75] Inventor: Yoshimichi Yamakita, Uozu, Japan

[73] Assignees: Yoshida Kogyo K.K.; Nissen Corporation, both of Tokyo, Japan

[21] Appl. No.: 813,828

[22] Filed: Dec. 27, 1985

[30] Foreign Application Priority Data

Dec. 28, 1984 [JP] Japan ..... 59-274896

[51] Int. Cl.[4] ..... B05C 3/05

[52] U.S. Cl. ..... 118/303; 68/58; 118/418

[58] Field of Search ..... 68/58, 59, 140; 8/158, 8/159; 118/19, 303, 416, 417, 418

[56] References Cited

U.S. PATENT DOCUMENTS

| | | | |
|---|---|---|---|
| 327,922 | 10/1885 | Crum | 68/59 |
| 425,127 | 4/1890 | Felts | 68/59 X |
| 2,895,321 | 7/1959 | Mayberry et al. | 68/58 X |
| 2,974,514 | 3/1961 | Buss et al. | 68/58 |
| 3,046,081 | 7/1962 | Smith et al. | 68/58 |
| 4,514,093 | 4/1985 | Coch et al. | 118/303 X |
| 4,530,305 | 7/1985 | Gunnell | 118/418 |

FOREIGN PATENT DOCUMENTS

| | | |
|---|---|---|
| 1235327 | 6/1971 | United Kingdom . |
| 1360491 | 7/1974 | United Kingdom . |
| 1419126 | 12/1975 | United Kingdom . |

*Primary Examiner*—Shrive P. Beck

*Attorney, Agent, or Firm*—Hill, Van Santen, Steadman & Simpson

[57] ABSTRACT

Objects molded of synthetic resin such as slide fastener sliders are dyed with a dye liquor having a bath ratio appropriate for an actual amount of dyestuff to be applied to the objects which has been determined from the outer surface area of the objects and the thickness of a dye layer to be formed thereon. The dye liquor is brought into contact with the objects while the dye liquor is being supplied in circulation through a dyeing tank or contained together with the objects in the dyeing tank.

4 Claims, 5 Drawing Figures

METHOD OF AND APPARATUS FOR DYEING PARTS MOLDED OF SYNTHETIC RESIN

BACKGROUND OF THE INVENTION

1. Field of the invention

The present invention relates to a method of and an apparatus for dyeing relatively small parts molded of synthetic resin, such as slide fastener sliders, snaps, buttons, or the like.

2. Description of the Prior Art

One conventional method of dyeing small parts or objects molded of synthetic resin has been to immerse the parts in a dye liquor. According to such a known dip dyeing process, the dye liquor used is 8 through 20 times, by weight, the objects to be dyed. The objects are accommodated in a perforated casing dipped in the dye liquor, and the cage is rotated or otherwise moved through the dye liquor to dye the objects.

The amount of dye liquor employed in the prior dyeing process is of a bath ratio which is appropriate for the normal dyeing of synthetic fibers which are dyed thoroughly. When the molded parts of synthetic resin are dyed, however, the dyestuff is applied only as thin surface layers to the parts and does not dye the material inside the outer surfaces. The dye solution required is several hundred times, by weight, the dyestuff actually applied to the objects. The degree of exhaustion is therefore quite low, for example 30%. Another problem is that color reproducibility is unstable because of the hydrophilic nature of the dye or the interaction between the synthetic resin objects and the dyeing assistants in the dye liquor. The dyed objects thus tend to differ in color from lot to lot.

The use of the large amount of dye liquor is also disadvantageous in that a cosiderable quantity of dye and dyeing assistants is wasted and an excessive amount of heating steam is consumed.

SUMMARY OF THE INVENTION

It is an object of the present invention is to provide a method of and an apparatus for efficiently and economically dyeing small parts molded of synthetic resin at a suitable bath ratio with a reduced amount of dye liquor for a higher degree of exhaustion and better color reproducibility.

According to the present invention, objects molded of synthetic resin are dyed with a dye liquor having a bath ratio appropriate for an actual amount of dyestuff to be applied to the objects which has been determined from the outer surface area of the objects and the thickness of a dye layer to be formed thereon. The dye liquor is brought into contact with the objects while the dye liquor is being supplied in circulation through a dyeing tank or contained together with the objects in the dyeing tank.

The dyestuff can be applied to the objects at a high degree of exhaustion such as 90% or 95% or higher, for example. The color reproducibility is good since the hydrophilic nature of the dyestuff is stable and also the effect of the dyestuff and dyeing assistants on the dyeing process is stable.

The bath ratio of the dye liquor is normally 2 or lower. To allow the dye liquor of such a low bath ratio to contact the surfaces of the objects uniformly, the objects are accommodated in the cylindrical casing or dyeing tank which is rotated to stir the objects in contact with the dye liquor.

Many other advantages and features of the present invention will become manifest to those versed in the art upon making reference to the detailed description and the accompanying sheets of drawings in which preferred embodiments incorporating the principles of the present invention are shown by way of illustrative example.

DETAILED DESCRIPTION

Figure 1:
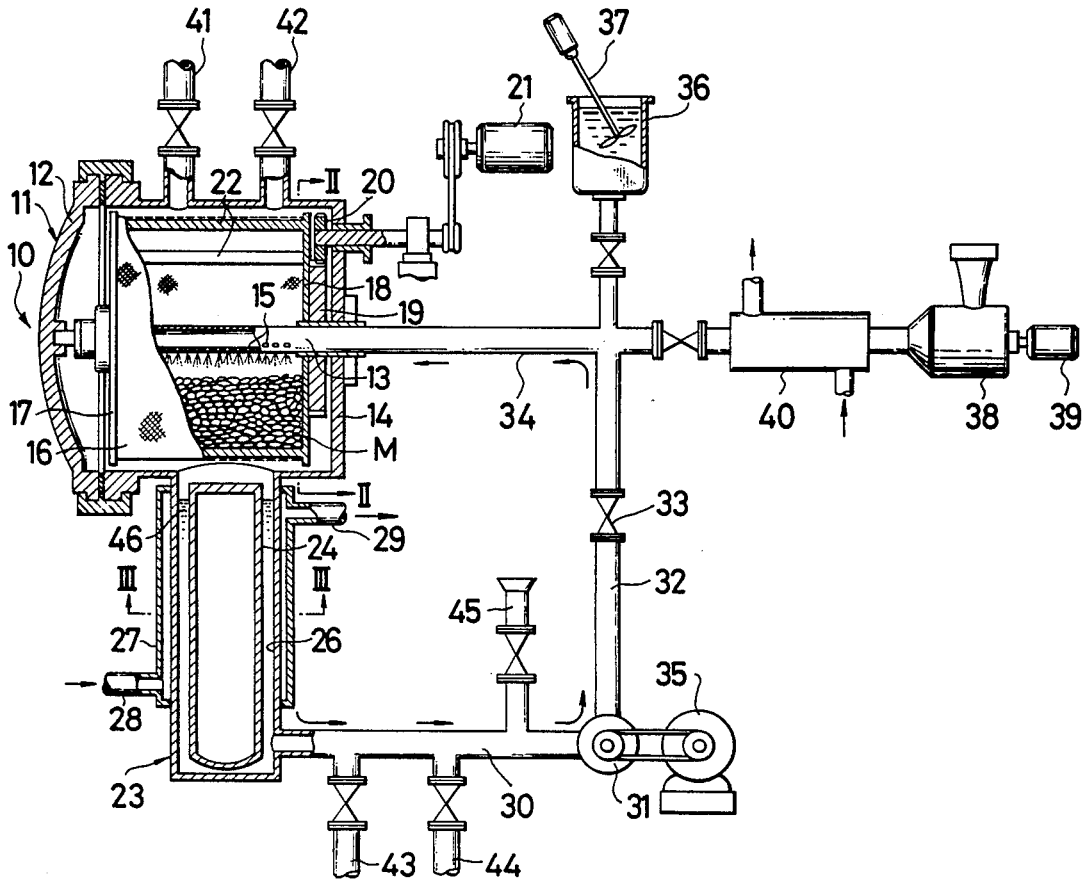
FIG. 1 is a side elevational view, partly in cross section, of a dyeing apparatus according to an embodiment of the present invention.

An example of a dyeing method of the present invention will first be described below.

(a) Slide fastener sliders molded of polyester were employed as objects to be dyed. The sliders had a specific gravity of 1.38, an outer surface area of 30.0 $cm^2/g.$, and a dyed layer having a thickness of 17 microns.

(b) The actual dyestuff applied to dye 15 kg. of the above sliders was:

$$30 \times 15{,}000 \times 0.0017 \times 1.38 \div 1{,}000 = 1.056 \text{ kg.}$$

(c) The amount of dye liquor having a bath ratio of 15 with respect to the above actual dyestuff was:

$$1.056 \text{ kg.} \times 15 = 15.84 \text{ kg.} = 15.84 \text{ liters}$$

(d) Dyes and dyeing assistants used in the above amount of dye liquor were as follows:

| Dye | Concentration % | Amount (g.) |
|---|---|---|
| C.I. disperse yellow 56 | 0.1 | 1.056 |
| C.I. disperse red 50 | 0.13 | 1.373 |
| C.I. disperse blue 149 | 1.12 | 11.827 |

*Concentration is the ratio with respect to the amount of objects dyed.

| Dyeing assistant | Ratio | Amount |
|---|---|---|
| Ammonium sulfate | 1 g./liter | 15.84 g. |
| Acetic acid (50%) | 1 cc/liter | 15.84 cc |
| Dispersing and leveling agent (Nonionic and anionic surfactants) | 0.5 g./liter | 7.92 g. |

*Ratio is the proportion with respect to the dye liquor.

(e) Dyeing conditions: 130° C., 40 minutes.

Therefore, the amount of dye liquor required for dyeing 15 kg. of sliders of synthetic resin was 15.84 liters which is small as compared with the conventionally required amount of dye liquor (the bath ratio is about 1), and the apparent volume of the dye liquor with 15 kg. of sliders to be dyed added was about 30.5 liters. The sliders could not be dyed with such an amount of dye liquor by the conventional dyeing process, but can only be dyed by dyeing apparatus of the present invention.

Figure 2:
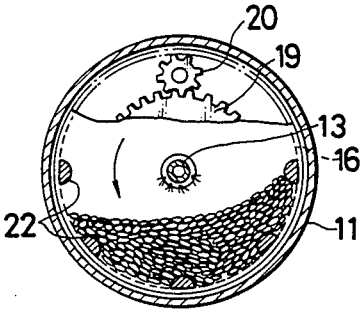
FIG. 2 is a cross-sectional view taken along line II—II of FIG. 1.
Figure 3:
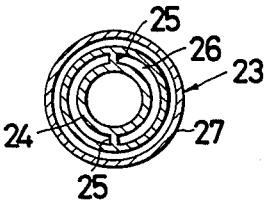
FIG. 3 is a cross-sectional view taken along line III—III of FIG. 1.

A dyeing apparatus according to an embodiment of the present invention will be described with reference to FIGS. 1 through 3.

The dyeing apparatus, generally designated at 10, includes a dyeing bath 11 substantially in the form of a horizontal hollow cylinder having a sealing lid 12 on one end thereof. A horizontal hollow shaft 13 extends coaxially in the dyeing bath 11 through a side wall 14 opposite to the sealing lid 12. The hollow shaft 13 has a plurality of small holes 15 defined in its lower portion for ejecting a dye liquor or solution.

A cylindrical casing 16 comprising a perforated drum or wire mesh is supported on and between a pair of axially spaced flanges 17, 18 for accommodating a number of objects M molded of synthetic resin. The casing 16 is rotatably mounted on the hollow shaft 13. The flange 17 has an opening (not shown) through which the objects M can be taken into and out of the casing 16 and a cover (not shown) for closing the opening. A gear 19 is fixed to the flange 18 in coaxial relation to the shaft 13 and held in mesh with a driver gear 20 disposed in the dyeing bath 11. The driver gear 20 can be rotated by a motor 21 operatively coupled therewith. A plurality of stirring ribs 22 (FIGS. 1 and 2) is disposed on the inner peripheral surface of the casing 16 and the ribs extend parallel to the shaft 13 for stirring the objects M as the casing 16 is rotated around the shaft 13.

A vertically elongate solution tank 23 is coupled centrally to the bottom of the dyeing bath 11. A hollow dummy body 24 is disposed centrally in the solution tank 23 and connected thereto by arms 25 (FIG. 3) for defining a solution reservoir 26 around the hollow dummy body 24. The solution tank 23 is partly surrounded by a heat exchanger jacket 27 through which heating steam can flow from an inlet pipe 28 to an outlet pipe 29. Alternatively, a heat exchanger comprising an electric heater may be disposed around the solution tank 23.

A circulation pipe 30 is connected between a lower portion of the solution tank 23 and a circulation pump 31, which is connected by a circulation pipe 32 and a valve 33 to a circulation pipe 34 coupled to the hollow shaft 13. The hollow shaft 13, the dyeing bath 11, the solution tank 23, the circulation pipe 30, the circulation pump 31, the circulation pipe 32, the valve 33, and the circulation pipe 34 jointly constitute a solution circulation system in which a dye solution or liquor is circulated by the circulation pump 31 driven by a motor 35.

A tank 36 for mixing dyeing assistants is connected through a valve to the circulation pipe 34, the tank 36 having a motor-driven stirrer 37.

An air blower 38 driven by a motor 39 for supplying drying air is coupled to a heat exchanger 40 connected through a valve to the circulation pipe 34.

A pressure air inlet port 41 is connected via a valve to the upper wall of the dyeing tank 11 for introducing air under pressure into the dyeing tank 11 to keep the interior thereof at a high pressure. Another air port 42 is connected via a valve to the upper wall of the dyeing tank 11 for discharging air out of the dyeing tank 11 or introducing air into the dyeing tank 11 at the time of discharging the dye liquor therefrom. A liquid inlet port 43 is connected via a valve to the circulation pipe 30 for supplying the dye liquor and cleaning water into the solution circulation system. A liquid outlet port 44 is connected via a valve to the circulation pipe 30 for discharging the used dye liquor and cleaning water from the solution circulation system. An air outlet port 45 is also coupled via a valve to the circulation pipe 30 for discharging drying air from the solution circulation system.

Operation of the dyeing apparatus thus constructed is as follows: First, water is supplied from the liquid inlet port 43 into the solution circulation system, and then a concentrated dye liquor is introduced from the tank 36 into the solution tank 23 until the solution reservoir 26 is filled with the dye liquor 46 of a desired concentration, which is heated up to a prescribed temperature by the heat exchanger 27.

The casing 16 with a number of objects M molded of synthetic resin accommodated therein up to $\frac{1}{3}$ through $\frac{1}{4}$ of the volume of the casing 16 is fitted over the hollow shaft 13 in the dyeing tank 11 with the gear 19 meshing with the gear 20. Then, the dyeing tank 11 is closed off by the sealing lid 12.

The motor 21 is energized to rotate the casing 16 around the hollow shaft 13. At the same time, the valve 33 is opened and the motor 35 is energized to enable the circulation pump 31 to supply the dye liquor through the circulation pipes 30, 32, 34 into the hollow shaft 13. The dye liquor is ejected from the holes 15 of the hollow shaft 13 and sprayed over the objects M, and then flows back into the solution tank 23. The dye liquor is continuously circulated through the solution circulation system to dye the objects M for a given period of time.

When the above dyeing process is over, the dye liquor is discharged from the liquid outlet port 44, and then cleaning water is supplied from the liquid inlet port 43. The cleaning water is circulated through the solution circulation system while the casing 16 with the objects M contained therein is being rotated. Thereafter, the cleaning solution is discharged from the liquid outlet port 44. After such a cleaning process is repeated several times, posttreatment processes such as a color fixing process and a finishing process are carried out, followed by a cleaning process in the same manner as above. Then, the air blower 38 is actuated to supply air to the heat exchanger 40, from which heated air is delivered into the hollow shaft 13. The dyed objects M are dried by the heated air supplied from the holes 15. The air having dryed the objects M is discharged from the air outlet port 45.

During the cleaning, posttreatment, and drying processes, the casing 16 is continuously rotated to allow the objects M to be processed uniformly and quickly.

The valves coupled to the solution circulation system and the valves 41, 42 are appropriately opened and closed in order to effect the aforesaid dyeing, cleaning, posttreatment, and drying processes.

After the objects M have been dried, the motor 21 is de-energized and the casing 16 is removed from the dyeing tank 11.

Figure 4:
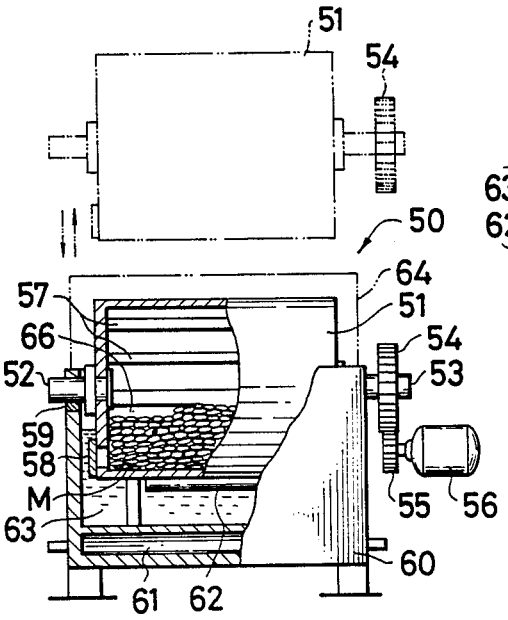
FIG. 4 is a side elevational view, partly in cross section, of a dyeing apparatus according to another embodiment of the present invention.
Figure 5:
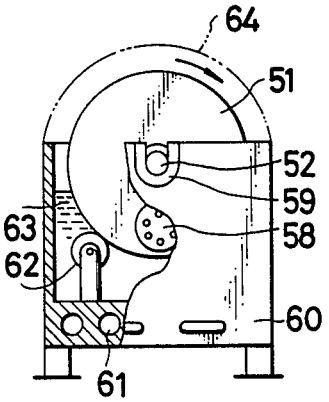
FIG. 5 is a front elevational view, partly broken away, of the dyeing apparatus shown in FIG. 4.

FIGS. 4 and 5 illustrate a dyeing apparatus according to another embodiment of the present invention. The dyeing apparatus, generally denoted at 50, includes a dyeing tank 51 in the form of a pressure-resistant hollow cylinder having a pair of central shafts 52, 53 projecting in axially opposite directions from the opposite end walls of the dyeing tank 51. A gear 54 fixed to the shaft 53 is held in mesh with a gear 55 secured to the output shaft of a motor 56. A plurality of stirring ribs 57 is attached to the inner peripheral surface of the dyeing tank 51 parallel to the shafts 52, 53. The end wall on which the shaft 52 is mounted has an opening through which objects M molded of synthetic resin can be taken into and out of the dyeing tank 51, the opening being openably closed by a sealing lid 58.

The dyeing tank 51 is rotatably supported in a heating tank 60 having a heater 61 such as a heat exchanger or an electric heater disposed in its bottom. The heating tank 60 has upwardly opening bearings 59 on which the shafts 52, 53 are rotatably supported. Support rollers 62 (one shown) are mounted on the bottom of the heating tank 60 and held in rolling engagement with the outer peripheral surface of the dyeing tank 51.

The heating tank 60 contains a liquid 63 of a high boiling point such as ethylene glycol with a lower portion of the dyeing tank 51 being immersed in the liquid 63. The dyeing tank 51 supported in the heating tank 60 has an upper exposed portion which is covered with an openable cover 64.

The dyeing apparatus shown in FIGS. 4 and 5 will operate as follows: The high-boiling-point liquid 63 is stored in the heating tank 60 and is heated thereby up to a prescribed temperature. A number of objects M molded of synthetic resin are placed into the dyeing tank 51 up to $\frac{1}{3}$ through $\frac{1}{4}$ of the volume thereof, the objects M being immersed in a given amount of dye liquor 66. The dyeing tank 51 is then closed by the sealing lid 58. The dyeing tank 51 is lowered by a lift (not shown) into the heating tank 60 so that the shafts 52, 53 are fitted into the bearings 59 and the outer peripheral surface of the dyeing tank 61 is held in rolling contact with the support rollers 62 with the gears 54, 55 meshing with each other.

The motor 56 is then energized to rotate the dyeing tank 51 for thereby moving the objects M with the dye liquor 66 therein. The outer surfaces of the objects M are now dyed by the dye liquor 66 held in contact therewith.

After the objects M have been dyed for a given interval of time, the dyeing tank 51 is removed from the heating tank 60, and the objects M and the dye liquor 66 are taken out of the dyeing tank 51. The dyed objects M are then cleaned, subjected to posttreatment processes, and finally dried.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for dyeing objects molded of synthetic resin with a dye liquor having a bath ratio appropriate for an actual amount of dyestuff to be applied to the objects which has been determined from the outer surface area of the objects to be dyed and the thickness of a dye layer to be formed on the objects, said apparatus comprising:

(a) a cylindrical dyeing tank;

(b) a stationary hollow shaft extending substantially horizontally and axially through said dyeing tank and having a plurality of holes defined exclusively in its lower portion for ejecting the dye liquor therethrough;

(c) a cylindrical casing rotatably mounted on said stationary hollow shaft in said dyeing tank and having a perforated peripheral wall for containing the objects therein;

(d) means for rotating said casing about said stationary hollow shaft;

(e) a vertically elongate solution tank coupled directly with the bottom of said dyeing tank and having a heater, said solution tank having a hollow dummy body disposed centrally therein and defining an elongate hollow annular solution reservoir between said solution tank and said dummy body; and (f) a solution circulation system connected between said hollow shaft and said solution tank for circulating the dye liquor through said hollow shaft, said casing, and said solution tank.

2. An apparatus according to claim 1, said casing having a plurality of stirring ribs disposed on the inner peripheral surface thereof and extending parallel to said hollow shaft for stirring the objects.

3. An apparatus according to claim 1, said dyeing tank including a sealing lid disposed on one end thereof and openable to allow said casing to be taken in and out of said dyeing tank.

4. An apparatus according to claim 1, said heater being disposed around said solution tank.

* * * * *